US007812783B2

(12) United States Patent
Mak et al.

(10) Patent No.: US 7,812,783 B2
(45) Date of Patent: Oct. 12, 2010

(54) MINIATURIZED ORTHOGONAL ANTENNA SYSTEM

(75) Inventors: Chi Lun Mak, Shatin (HK); Corbett R. Rowell, Shatin (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 967 days.

(21) Appl. No.: 11/612,315

(22) Filed: Dec. 18, 2006

(65) Prior Publication Data

US 2008/0143602 A1 Jun. 19, 2008

(51) Int. Cl.
*H01Q 3/24* (2006.01)
*H01Q 1/38* (2006.01)

(52) U.S. Cl. ..... 343/876; 343/700 MS

(58) Field of Classification Search ..... 343/700 MS, 343/702, 876

See application file for complete search history.

(56) References Cited

U.S. PATENT DOCUMENTS 5,420,599 A * 5/1995 Erkocevic ..... 343/828
5,661,489 A 8/1997 Baker
7,183,980 B2 * 2/2007 Chang et al. ..... 343/700 MS
2003/0016176 A1 1/2003 Kingsley et al.
2003/0184478 A1 10/2003 Kingsley et al.
2006/0125704 A1 6/2006 Melconian et al.
2006/0187118 A1 8/2006 Kimata
2006/0290575 A1 * 12/2006 Pelzer ..... 343/702

FOREIGN PATENT DOCUMENTS

CN 1471194 1/2004

* cited by examiner

*Primary Examiner*—Tan Ho
(74) *Attorney, Agent, or Firm*—Fulbright & Jaworski L.L.P.

(57) ABSTRACT

A system for providing multiple antenna patterns comprises a first antenna element, a second antenna element, wherein the first and second antenna elements are coplanar and arranged orthogonally with respect to each other in the plane, and a feed circuit in communication with a signal feed line alternately connecting the signal feed line to each of the first and second antenna elements.

27 Claims, 5 Drawing Sheets

MINIATURIZED ORTHOGONAL ANTENNA SYSTEM

TECHNICAL FIELD

The present description is related to antenna systems and, more specifically, to miniaturized systems for providing at least two patterns.

BACKGROUND OF THE INVENTION

Human vision is limited to the visual spectrum—i.e., the colors of the rainbow. Below the visual spectrum lies the Radio Frequency (RF) spectrum. RF signals are used for a variety of applications, including radio and television broadcasts, cellular communications, satellite communications, and the like. Because humans cannot see RF signals, tools have been developed to aid in the identification of transmitting bodies.

Many prior art solutions use one or more antennas to derive direction and/or location of transmitters. For example, one solution uses several horn-shaped antenna elements arranged around a large, cylindrical reflector, with the elements feeding into several signal processors. This produces a wide-angle view of the environment. Another solution uses an array of loop elements and an array of dipole elements to create an electronically steerable beam. However, these solutions tend to be quite large and complex, employing a number of signal processors and feeds.

Thus, a limitation of some prior art systems is that they are too large, too complex, and too expensive to be deployed in consumer devices, especially hand-held devices. Currently, there is no miniaturized system on the market that provides direction of origin information for transmitters and that can be produced inexpensively and can fit into a hand-held device.

BRIEF SUMMARY OF THE INVENTION

Various embodiments of the invention are directed to systems and methods for use in providing configurable patterns with miniaturized antenna systems. In one example system, the structure is etched on an inexpensive Printed Circuit Board (PCB). An example system includes two antennas and one switching circuit. The two antennas are substantially identical and placed orthogonally (transposed) to each other. In addition, they are ungrounded type antennas (i.e., do not overlap a ground plane) for wider bandwidth performance.

Various techniques may be used to miniaturize the example system. For instance a Planar Inverted-F Antenna (PIFA) technique can be employed for which a shorting strip is introduced for each antenna. Further, the antennas can also be constructed as meanders to minimize the space used in at least one dimension. Apart from having the benefit of small size, the meander-shape generally creates a notch within each antenna structure, which can help to minimize mutual coupling between the antennas. A switched feed operates to alternately feed each antenna, thereby producing two orthogonal antenna patterns.

In an example method, each of the antennas are alternately "turned on" and off at a high frequency to sample a received signal using the orthogonal patterns. Information derived from the received signal can be used by a processor-based device to generate direction information for the transmitter.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present inventions reference is now made to the following descriptions taken in conjunction with the accompanying drawings in which.

DETAILED DESCRIPTION OF THE INVENTION

Figure 1:
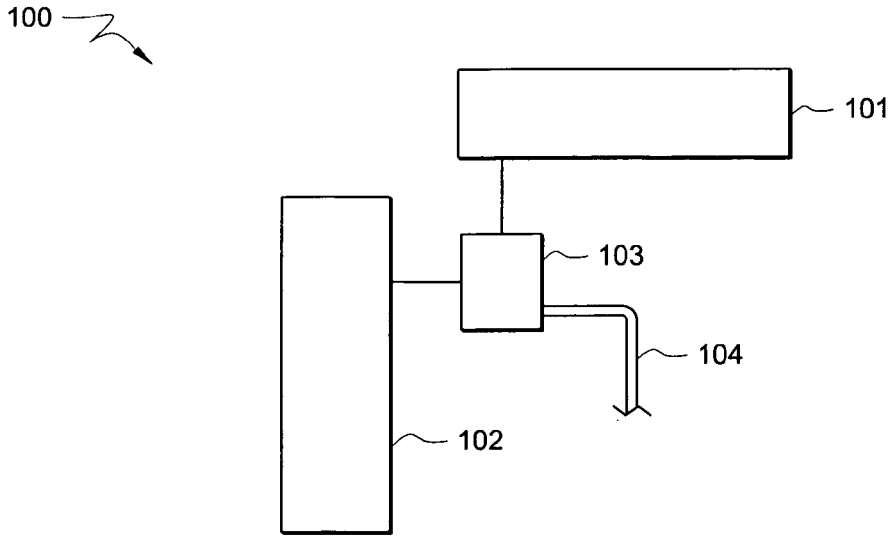
FIG. 1 is an illustration of an exemplary system adapted according to one embodiment of the invention.

FIG. 1 is an illustration of exemplary system 100 adapted according to one embodiment of the invention. System 100 includes antenna elements 101 and 102 as well as switched feed circuit 103 and signal feed line 104. Antenna elements 101 and 102 are coplanar and orthogonal to one another. Switched feed circuit 103 is operable to alternately provide each antenna element 101 and 102 with a connection to signal feed line 104. Thus, system 100 can be referred to as an alternately-fed orthogonal antenna system.

Figure 2:
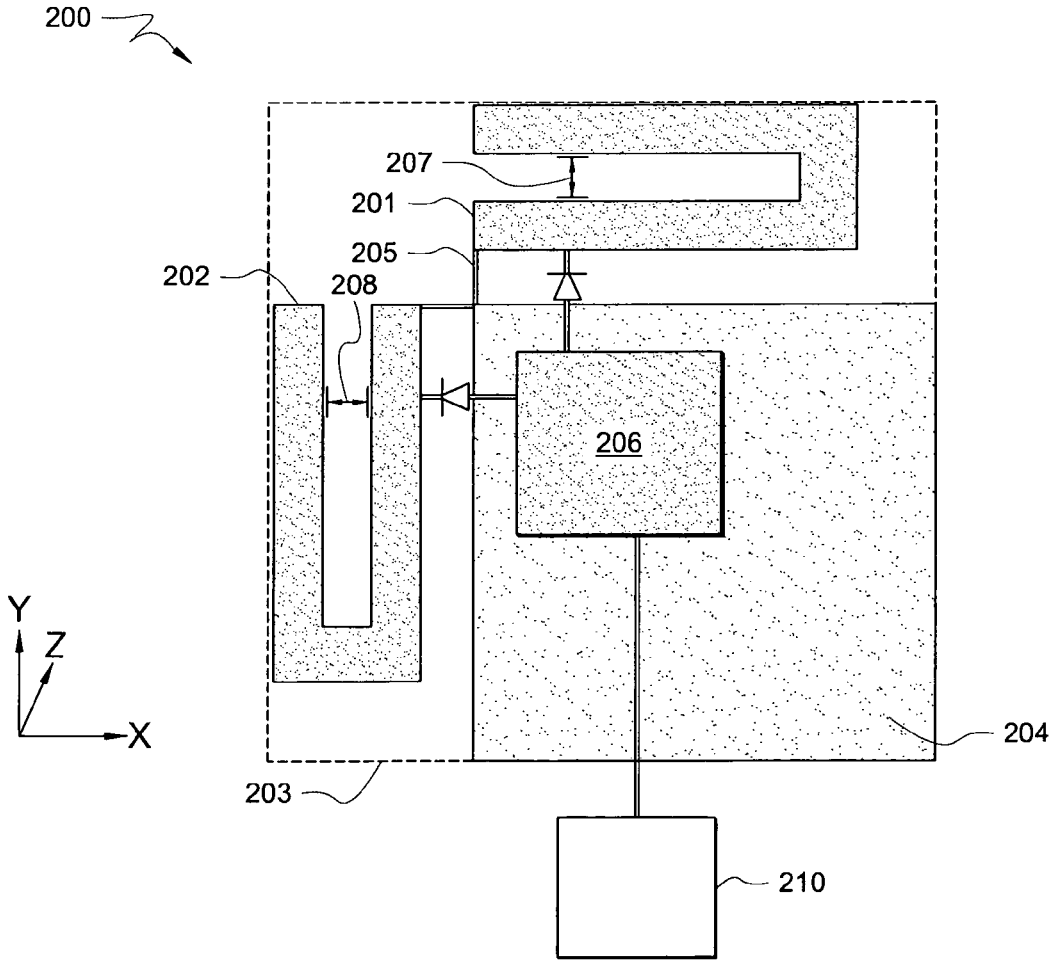
FIG. 2 is an illustration of an exemplary system adapted according to one embodiment of the invention.

FIG. 2 is an illustration of exemplary system 200 adapted according to one embodiment of the invention. System 200 includes first and second antenna elements 201 and 202 that are arranged orthogonally as in system 100 (FIG. 1). Antenna elements 201 and 202 are in communication with switched feed circuit 206, which, as shown, is a diode-based circuit, and its operation is explained more fully below.

In the embodiment of system 200, various components are disposed in and upon Printed Circuit Board (PCB) 203, the borders of which are shown in dashed line. It is not required that all components of system 200 be disposed upon PCB 203, as various layers of PCB 203 can be used for different components. In this example, ground plane 204 is in a layer below that of switched feed circuit 206. Various embodiments of the invention are not limited by substrate or arrangement thereon.

Antenna elements 201 and 202 are ungrounded in system 200. In other words, antenna elements 201 and 202 do not overlap with ground plane 204. Generally, ungrounded antennas have a lower Q factor and a wider bandwidth that similarly-shaped grounded antennas. In effect, this trades some amount of efficiency for a broader operating spectrum. In a miniaturized antenna system, such as system 200, the trade-off may be beneficial if it allows the use of smaller or fewer antenna elements in the design.

Each of antenna elements 201 and 202 are Planar Inverted F Antennas (PIFAs). Further, antenna elements 201 and 202 are configured as meander lines on PCB 203. PIFAs and meanders are antenna designs that usually lend some amount of space efficiency to their applications. For instance, in the embodiment of system 200, antenna elements 201 and 202 fit longer radiating lengths into a shorter area by doubling back. This may allow system 200 to be used in a space-sensitive application, such as a hand-held device (e.g., phone, jammer identifier, Wireless Fidelity (WiFi) hot spot finder, and the like). Another space-saving technique present in system 200 is use of wire shorts 205 to connect antenna elements 201 and 202 to ground plane 204. Wire shorts generally allow a designer to use a smaller antenna element without a loss in bandwidth. Wire shorts can sometimes be applied to reduce antenna element size by up to fifty percent.

Further, antenna elements 201 and 202 are arranged symmetrically with respect to an axis in the x-y plane starting in the upper left corner and extending diagonally. This is a further space-saving measure, allowing antenna elements 201 and 202 to be placed close to the upper left corner of PCB 203. Antenna elements 201 and 202 are placed such that element 201 does not encroach into the x-axis area of element 202, nor does element 202 encroach into the y-axis area of element 201. In system 200, this minimizes interference between elements 201 and 202. Notches 207 and 208 further operate to minimize mutual coupling. Taken together, the space-saving techniques of system 200 allow for increased miniaturization, including miniaturization of elements 201 and 202 as well as a fairly tightly arranged placement of components on PCB 204.

System 200, as mentioned above, is a miniaturized system. However, some embodiments of the invention are not limited to using all of the miniaturizing techniques in FIG. 2. For example, in systems wherein space efficiency is a lower priority, size may be sacrificed to increase efficiency. Further, other miniaturizing techniques now known or later developed may be employed in addition to or alternatively to the techniques described above. Additionally, the symmetric relationship is not required in every embodiment.

In system 200, antenna elements 201 and 202 are substantially identical, though their spatial arrangements are different (e.g., inverted and mirror-imaged). That is, if each of antenna elements 201 and 202 were isolated and observed, they would provide the same or very similar performance given the same spatial arrangement and stimuli. In system 200, this relationship produces orthogonal antenna patterns when elements 201 and 202 are alternated in operation.

Figure 8:
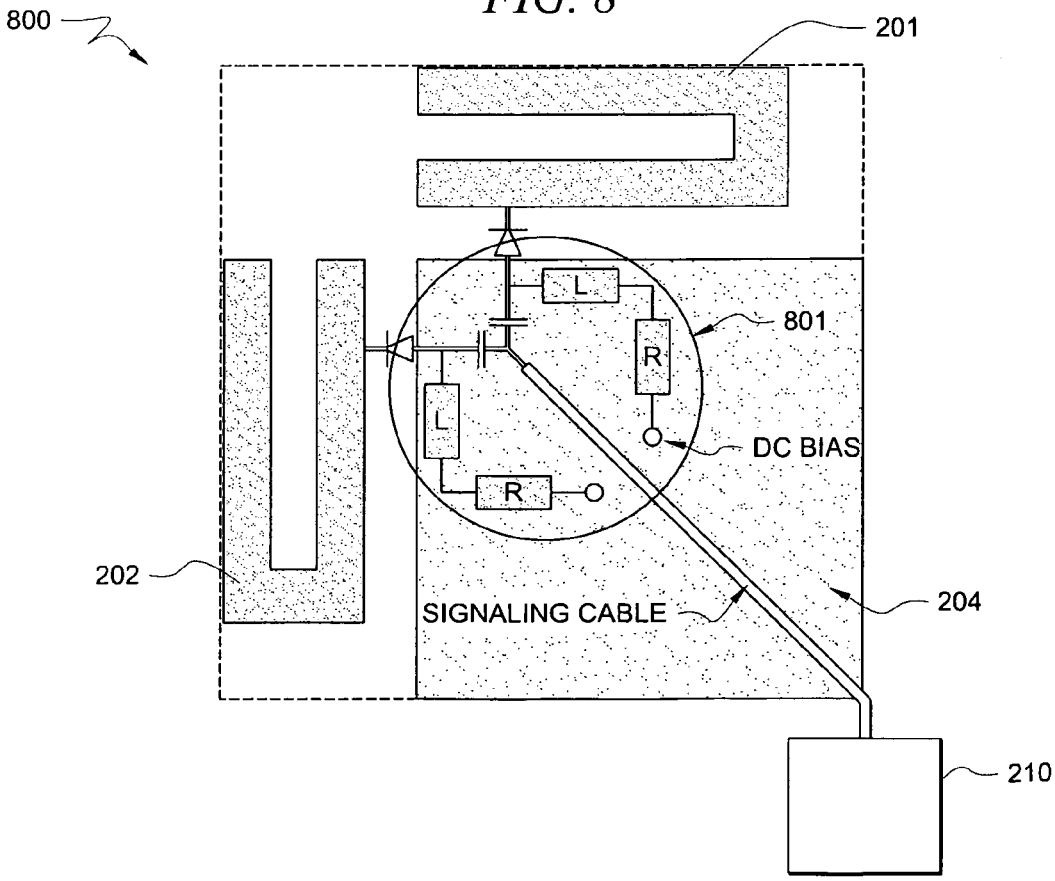
FIG. 8 is an illustration of an exemplary system adapted according to one embodiment of the invention.

Specifically, elements 201 and 202 produce "figure-8" radiation patterns in the azimuthal direction when they are operated in an alternating manner. Since elements 201 and 202 are orthogonal, the peak in the radiation pattern of 201 is the null in the radiation pattern of element 202 (and vise-versa). It should be noted that the patterns produced when elements 201 and 202 are alternated is different than the patterns produced when elements 201 and 202 are operated simultaneously. This is due to mutual coupling. Thus, in order to produce two orthogonal patterns, circuit 206 should be controlled to time the switching accordingly. For some applications, switched feed circuit 206 activates one element 201, 202 at a time and switches very quickly. In this way, system 200 can obtain two signal levels (one from each orthogonal pattern) and by comparing the signal levels, processor-based computing unit 21 determines the direction of a radiation source.

In a very specific example, PCB 203 is 25 mm by 25 mm in the x and y directions and 1.6 mm thick in the z-direction. Each of antenna elements 201 and 202 are 20×8×1.6 mm (including notches 207 and 208). Given this configuration, system 200 operates at least in the 2.5 GHz Industrial Scientific and Medical (ISM) band and can provide a fifteen dB peak-to-null ratio. Thus, the x and y dimensions of system 200 are each less than a quarter of a wavelength, giving system 200 an impressive factor of miniaturization. This is in comparison to dipole elements, which are another type of ungrounded antenna element, generally around a half-wavelength long.

Size and shape of antenna elements are usually the primary factors determining the operating frequencies of antenna elements, and the sizes and shapes of antenna elements 201 and 202 can be modified for use in a variety of other frequency bands. For example, other embodiments can operate in cellular telephone bands, WiFi bands. Ultra Wide Band (UWB) bands, and the like. Further, antenna elements 201 and 202 can be shaped to produce patterns other than figure-8 patterns, e.g., cardioids and the like.

While operation of antenna system 200 is discussed above with reference to transmission of signals, it should be noted that reception of signals operates in the same way but in a different direction. In other words, each element 201 and 202 receives a signal and provides it to switched feed 206, which alternatingly passes the received signals to other circuitry, such as computing unit 210. Circuitry to produce signals for transmission may be located in computing unit 210 or elsewhere.

Figure 3:
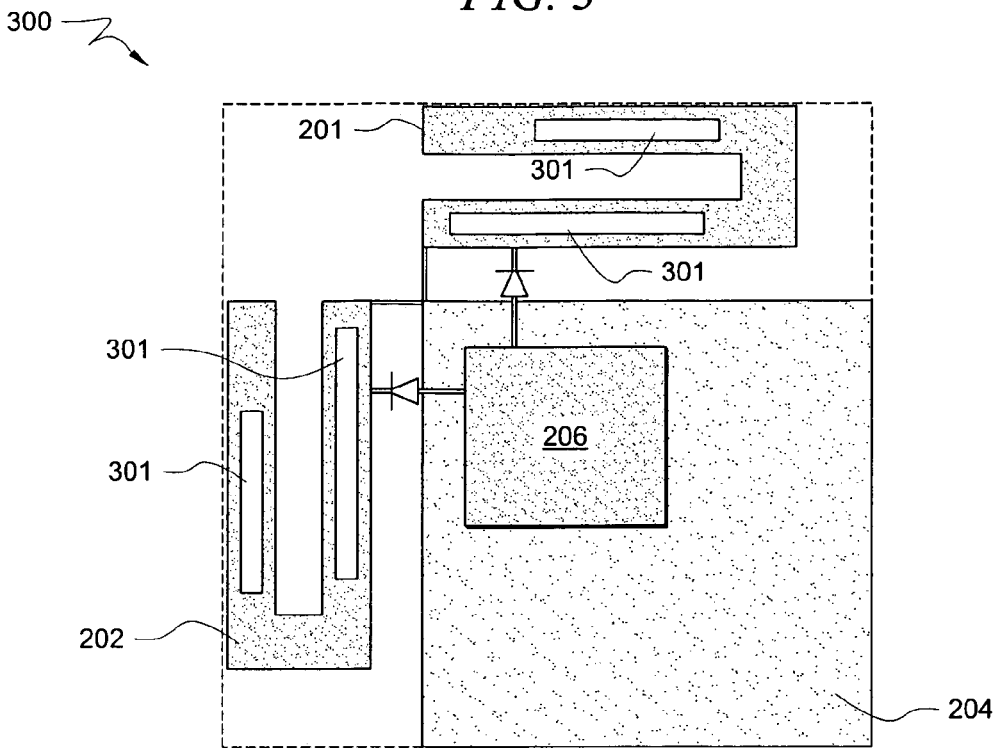
FIG. 3 is an illustration of an exemplary system adapted according to one embodiment of the invention.

FIG. 3 is an illustration of exemplary system 300 adapted according to one embodiment of the invention. System 300 is similar to system 200 (FIG. 2) and further includes slots 301. Slots 301 are within the radiating portions of antenna elements 201 and 202, and cancel, at least in part, the impedance of switched feed circuit 206. In addition, slots 301 can increase the three-dimensional radiation efficiency and create independently correlated antenna patterns. In some embodiments, antenna elements 201 and 202 can be made of metal and deposited upon a PCB using known techniques. In such cases, slots 301 can often be formed in the same steps that form elements 201 and 202.

Figure 4:
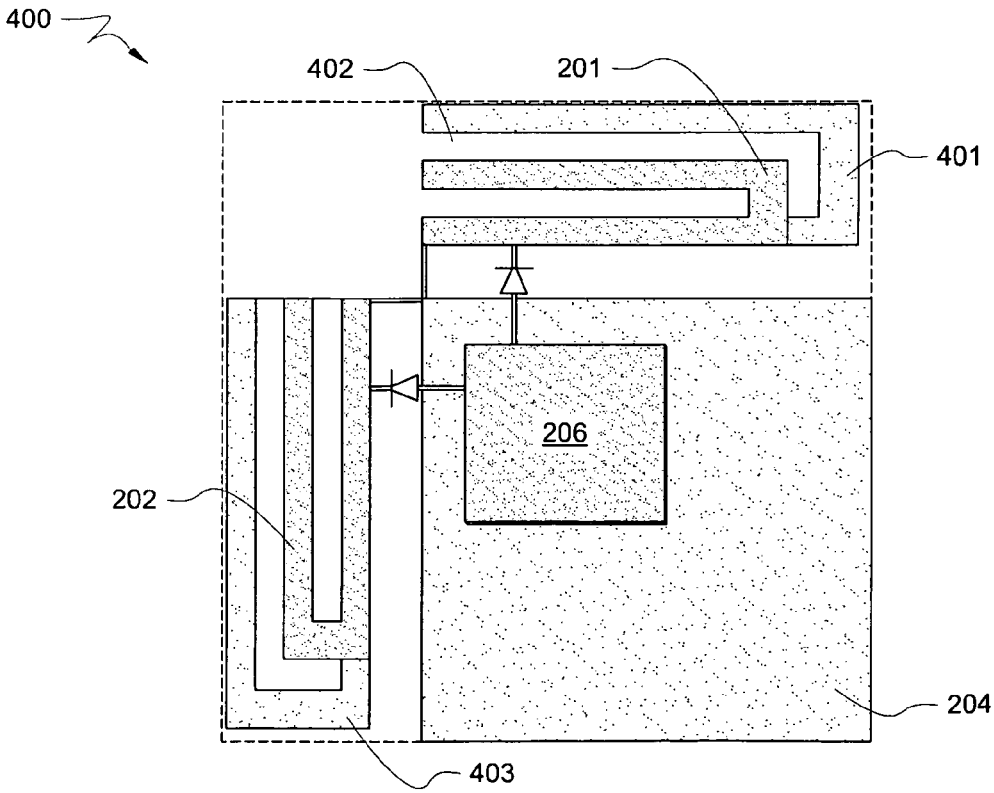
FIG. 4 is an illustration of an exemplary system adapted according to one embodiment of the invention.

FIG. 4 is an illustration of exemplary system 400 adapted according to one embodiment of the invention. System 400 is similar to system 200 (FIG. 2), and it further includes additional radiating structures 401 and 403. Structures 401 and 403 also define respective notches 402 and 404. The addition of structures 401 and 403 provides at least one additional band of operation to system 400. Similar to elements 201 and 202, structures 401 and 403 are substantially identical. Further, notches 402 and 404 reduce mutual coupling. Strictures 401 and 403 can be laid out as extensions from elements 201 and 202, or they can be separate elements located in different layers of the substrate.

Figure 5:
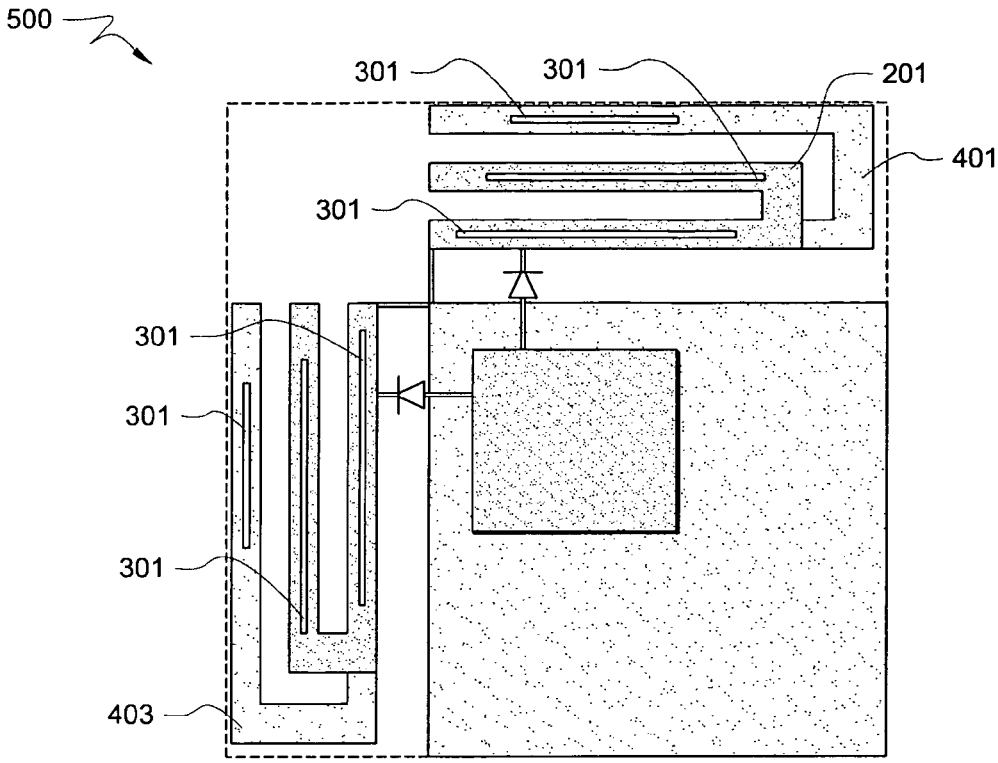
FIG. 5 is an illustration of an exemplary system adapted according to one embodiment of the invention.

FIG. 5 is an illustration of exemplary system 500 adapted according to one embodiment of the invention. System 500 is similar to system 400 (FIG. 4) with the addition of slots 301 to structures 401 and 403.

Figure 6:
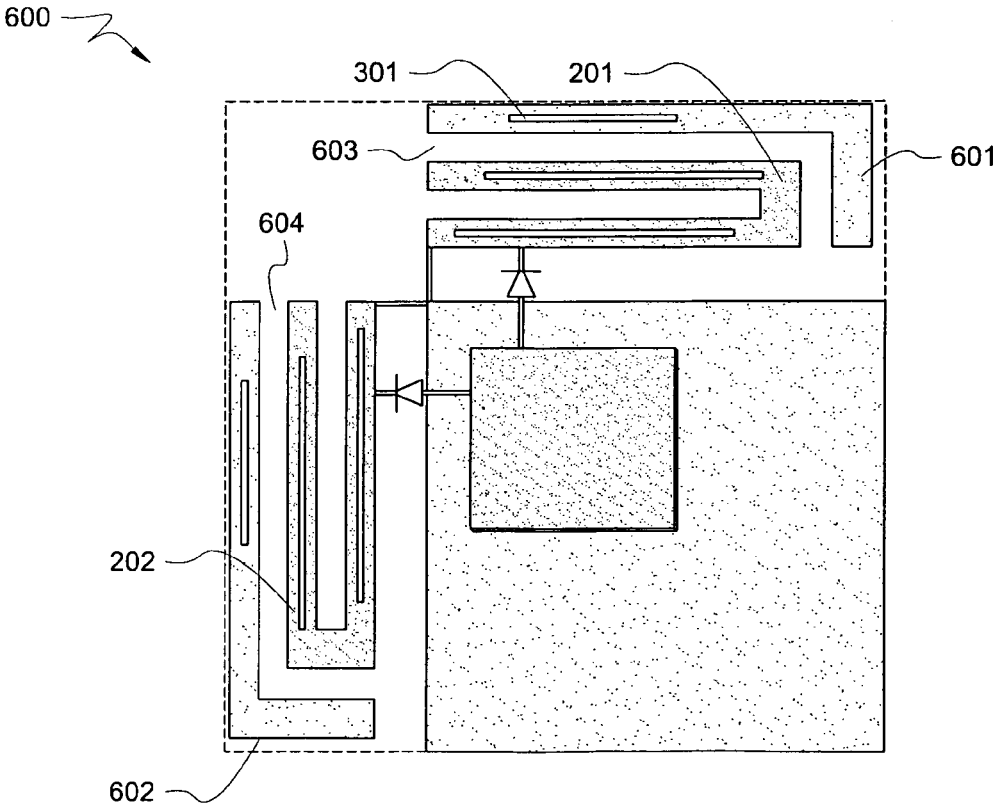
FIG. 6 is an illustration of an exemplary system adapted according to one embodiment of the invention.

FIG. 6 is an illustration of exemplary system 600 adapted according to one embodiment of the invention. System 600 is similar to system 200 (FIG. 2) with the addition of parasitic elements 601 and 602. Parasitic elements 601 and 602 define additional notches 603 and 604, again, for minimizing mutual coupling. The addition of parasitic elements 601 and 602 to system 600 allows for better impedance performance. Additionally elements 601 and 602 can be used to provide for extra operating bands. Some embodiments may omit slots 301.

Figure 7:
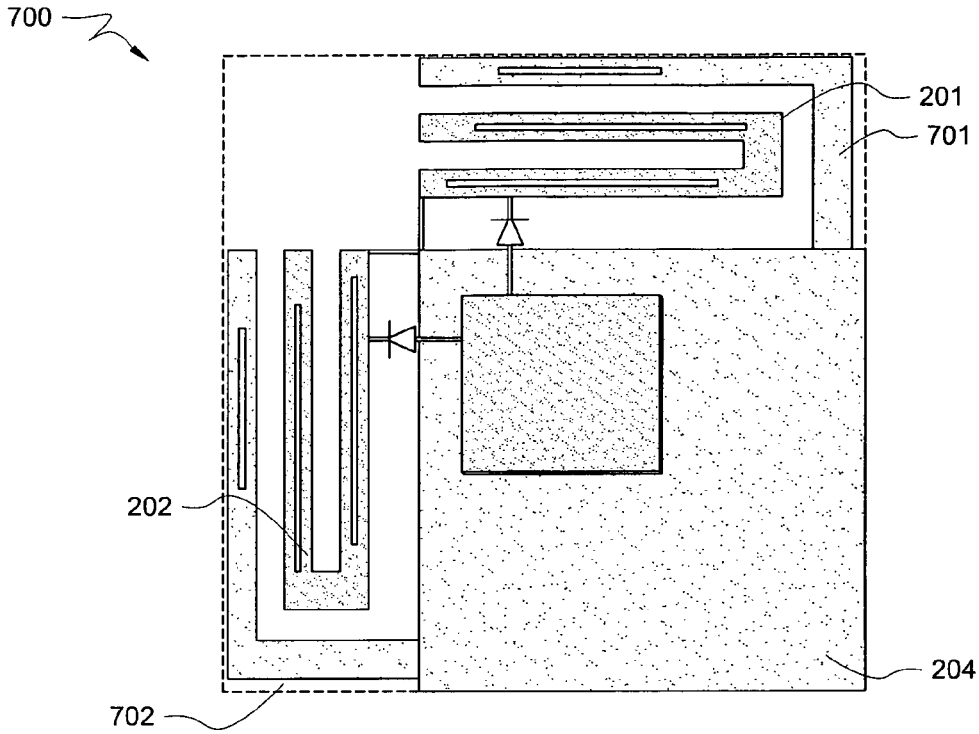
FIG. 7 is an illustration of an exemplary system adapted according to one embodiment of the invention.

FIG. 7 is an illustration of exemplary system 700 adapted according to one embodiment of the invention. System 700 is similar to system 600 (FIG. 6), except that parasitic elements 701 and 702 are connected to ground 204. As in system 600, parasitic elements 701 and 702 provide for improved impedance performance. Further, since elements 701 and 702 are shorted to ground, they offer better performance in extra bands than that offered by the parasitic elements of system 600. Some embodiments may omit slots 301.

FIGS. 4-7 illustrate that embodiments of the invention are scalable to include other components to add or modify functionality. Additionally to or alternatively to any of the arrangements shown in FIGS. 4-7, other components may be used. For example additional antenna elements or parasitic elements may be added to any of the embodiments shown, such that a given system may have two, four, six, eight, or any number of components.

FIG. 8 is an illustration of exemplary system 800 adapted according to one embodiment of the invention. System 800 includes switched feed circuit 801 which is one way to implement circuit 103 (FIG. 1). Circuit 801 includes Resistive Inductive Capacitive (RLC) components in each branch to provide DC bias to the diodes. Each antenna element 201 and 202 can be turned on by biasing its respective diode. Any of a variety of analog or digital oscillators can be used to provide a switching frequency.

Slots 301 (FIG. 3) can be especially beneficial with embodiments that employ a diode circuit, such as circuit 801. Specifically, slots 301 can be used to cancel, at least in part, the impedance of the diodes, thereby providing better performance for the antenna system. The increased performance can make up for at least some of the efficiency sacrifices made for miniaturization. Some resulting embodiments include effective, miniaturized systems.

Other techniques exist to excite antenna elements 201 and 202 in an alternating manner. For example, another embodiment may dispense with diodes and use transistors as switches. In fact, various embodiments may employ any of a variety of switching techniques now known or later developed.

Figure 9:
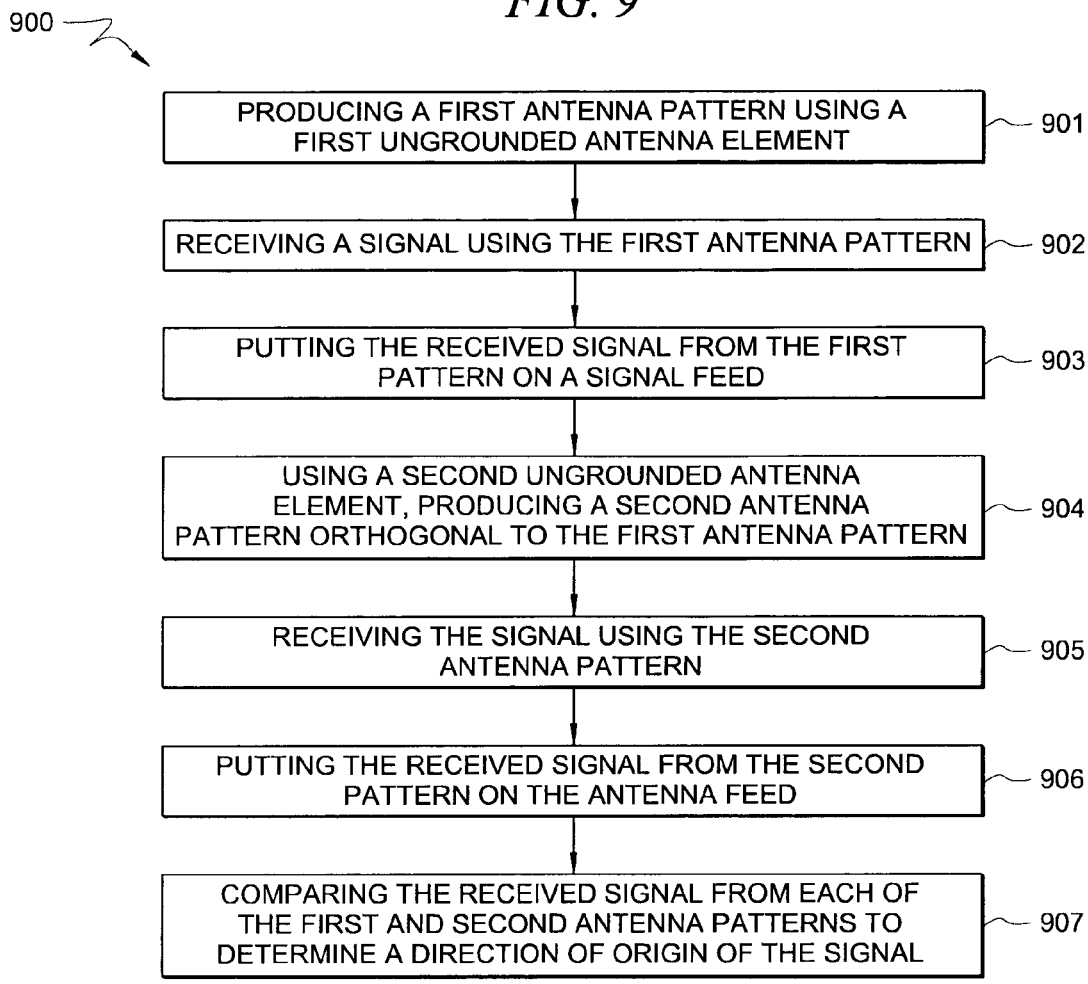
FIG. 9 is an illustration of an exemplary method adapted according to one embodiment of the invention.

FIG. 9 is an illustration of exemplary method 900 adapted according to one embodiment of the invention. Method 900 is one way of using various antenna system embodiments described herein. Method 900 may be performed by, e.g., a logical device that is operable to control a miniaturized antenna system to send and receive signals and is operable to process signals for transmission or reception. Such logical device may be processor-based, using a Digital Signal Processor (DSP) chip, an Application Specific Integrated Circuit (ASIC), or other processor, and it may include other components, such as Radio Frequency (RF) modulators, demodulators, amplifiers, and the like. The logical device may be all on one Semiconductor chip, or spread out among several, discrete components.

In step 901, a first antenna pattern is produced using a first ungrounded antenna element. This can be performed, for example, by turning the element on through use of a switched feed so that the element is in communication with a signal feed line.

In step 902, a signal is received using the first antenna pattern. In step 903, the received signal from the first pattern is put on a signal feed. In this example, the signal feed connects the first antenna element to other circuitry, such as RF components, signal processors, amplifiers, filters, and/or the like.

In steps 904-906, steps 901-903 are repeated with a second ungrounded antenna element to produce an orthogonal antenna pattern. The signal is received by the orthogonal antenna pattern and put on the signal feed. The result is that a component receiving the signals from the signal feed line has two signal levels, each from an orthogonal pattern. Switching between a first and second antenna element can be performed using a switched feed circuit, such as that shown in FIG. 8.

In step 907, the received signal from each of the first and second antenna patterns is compared to determine a direction of origin of the signal. For example, the system can compare the relative strengths of the signal in each antenna pattern and reliably calculate a direction to the transmitter. One technique that can be used is triangulation.

While method 900 is shown as a linear series of discrete steps, it should be noted that various embodiments can add, omit, and/or rearrange steps. For example, in many embodiments, steps 901-903 occur nearly simultaneously. The same can be said for steps 904-906. Additionally, the steps can he repeated and other processing can be performed on the signal. For instance, the directional information from two or more devices performing method 900 can be used to calculate a location of a transmitter, assuming the positions of the devices are known.

Figure 10:
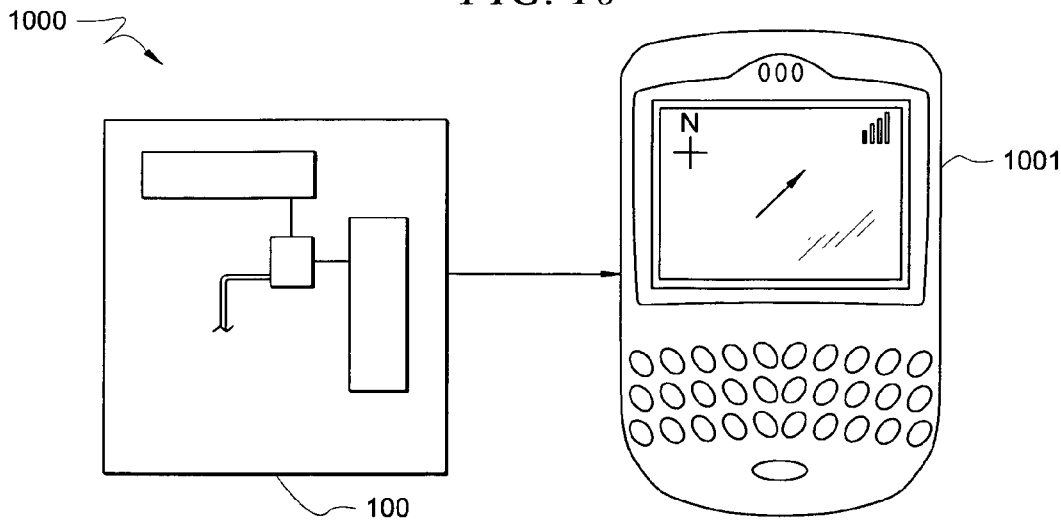
FIG. 10 is an illustration of an exemplary system adapted according to one embodiment of the invention.

FIG. 10 is an illustration of exemplary system 1000 adapted according to one embodiment of the invention. System 1000 illustrates one application of system 100 (FIG. 1) (or a variety of other embodiments, for that matter). In system 1000, system 100 is incorporated into hand-held device 1001. Since system 100 can be adapted to provide directional information, device 1001 may be put to a variety of tasks, including, e.g. jammer finding, electromagnetic interference source locating, friend locating, WiFi hotspot locating, and the like.

Embodiments of the invention may provide one or more advantages over prior art solutions. For example previous phased array systems that used arrays of dipoles and loops were very complex, both mechanically and logically, and were also generally very large. Embodiments of the invention, however, can be miniaturized so that x and y dimensions are shorter than a quarter wavelength, and sometimes even smaller. Furthermore, prior art systems often use separate feed systems for each element or array. By contrast, embodiments of the present invention can use a switched feed, and through use of slots (as in FIG. 3), can compensate for the switching effects. Another advantage of some embodiments is that they can be produced using inexpensive techniques. For example, the antenna elements, feed line, and wires shorts can be made using standard techniques (e.g., etching) to place them on one or more PCBs. Other components, such as switched feed, RF modules, processors, can be placed on PCBs using standard mounting techniques. (Though it should be noted that various embodiments do not necessarily have to be PCB-mounted, as one or more other mounting systems can be used.)

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for providing multiple antenna patterns, said system comprising:

a first ungrounded antenna element;

a second ungrounded antenna element, wherein said first and second antenna elements are coplanar and arranged orthogonally with respect to each other in said plane;

a feed circuit in communication with a signal feed line alternately connecting said signal feed line to each of said first and second antenna elements; and a processor-based system in communication with said signal feed line receiving signals from each of said first and second antenna elements and determining a direction of origin for said received signals.

2. The system of claim 1 wherein said first and second antenna elements are substantially identical and arranged symmetrically with respect to a coplanar axis.

3. The system of claim 1 wherein each of said first and second antenna elements are Planar Inverted F Antennas (PIFAs).

4. The system of claim 1 wherein each of said first and second antenna elements are meander lines and each of said first and second antenna elements defines a notch therein.

5. The system of claim 1 wherein each of said first and second antenna elements are connected to a ground plane through a wire short.

6. The system of claim 1 mounted in a hand-held wireless device.

7. The system of claim 1 wherein said first and second antenna elements are packaged on a substrate, each dimension of said substrate being less than a quarter of a wavelength of an operating frequency of said system.

8. The system of claim 1 in which the first ungrounded antenna element produces a first radiation pattern, and wherein the second ungrounded antenna element produces a second radiation pattern orthogonal to the first radiation pattern.

9. A system for providing multiple antenna patterns, said system comprising:

a first ungrounded antenna element;

a second ungrounded antenna element, wherein said first and second antenna elements are coplanar and arranged orthogonally with respect to each other in said plane; and a feed circuit in communication with a signal feed line alternately connecting said signal feed line to each of said first and second antenna elements, wherein said feed circuit comprises:

a diode-based switching circuit, and wherein each of said first and second antenna elements comprise:

a meander line with at least one slot within said line canceling at least some impedance of said diode-based switching circuit.

10. The system of claim 9 in which the first ungrounded antenna element produces a first radiation pattern, and wherein the second ungrounded antenna element produces a second radiation pattern orthogonal to the first radiation pattern.

11. A system for providing multiple antenna patterns, said system comprising:

a first ungrounded antenna element;

a second ungrounded antenna element, wherein said first and second antenna elements are coplanar and arranged orthogonally with respect to each other in said plane;

a feed circuit in communication with a signal feed line alternately connecting said signal feed line to each of said first and second antenna elements;

a third ungrounded antenna element parallel to said first antenna element; and a fourth ungrounded antenna element parallel to said second antenna element, wherein said third and fourth antenna elements are substantially identical and arranged orthogonally with respect to each other.

12. The system of claim 11 in which the first ungrounded antenna element produces a first radiation pattern, and wherein the second ungrounded antenna element produces a second radiation pattern orthogonal to the first radiation pattern.

13. A system for providing multiple antenna patterns, said system comprising:

a first ungrounded antenna element;

a second ungrounded antenna element, wherein said first and second antenna elements are coplanar and arranged orthogonally with respect to each other in said plane;

a feed circuit in communication with a signal feed line alternately connecting said signal feed line to each of said first and second antenna elements;

a first parasitic element arranged parallel to said first antenna element; and a second parasitic element arranged parallel to said second antenna element.

14. The system of claim 13 wherein said first and second parasitic elements are shorted to a ground plane.

15. The system of claim 13 in which the first ungrounded antenna element produces a first radiation pattern, and wherein the second ungrounded antenna element produces a second radiation pattern orthogonal to the first radiation pattern.

16. A method for producing signals, said method comprising:

producing a first antenna pattern using a first ungrounded antenna element; and using a second ungrounded antenna element, producing a second antenna pattern orthogonal to said first antenna pattern, wherein said first and second antenna elements are coplanar, orthogonally oriented, and miniaturized to be less than a quarter wavelength long, wherein said antenna elements are in communication with a feed circuit, said feed circuit comprising:

a diode-based switching circuit, and wherein each of said antenna elements comprise:

a meander line with at least one slot within said line canceling at least some impedance of said diode-based switching circuit.

17. An antenna system comprising:

a first meander antenna element;

a substantially identical second meander antenna element coplanar with the first, said elements arranged orthogonally and symmetrically with respect to a coplanar axis between said elements; and a feed circuit with a switch unit alternately providing a same signal feed to each of said first and second antenna elements, wherein each of said first and second antenna elements are ungrounded and configured to include at least one slot within a radiating portion.

18. The system of claim 17 wherein said antenna elements are Planar Inverted F Antennas (PIFAs).

19. The system of claim 17 wherein said antenna elements are each connected to a ground plane by a respective wire short.

20. The system of claim 17 further comprising:

a processor-based system with an input for signals received from said first and second antenna elements, said processor based system deriving information indicating a direction of origin of a transmitter of said signals.

21. A method for producing signals, said method comprising:

producing a first antenna pattern using a first ungrounded antenna element;

using a second ungrounded antenna element, producing a second antenna pattern orthogonal to said first antenna pattern, wherein said first and second antenna elements are coplanar, orthogonally oriented, and miniaturized to be less than a quarter wavelength long;

receiving a signal using said first antenna pattern;

putting said received signal from said first pattern on a signal feed;

receiving said signal using said second antenna pattern;

putting said received signal from said second pattern on said antenna feed; and comparing said received signal from each of said first and second antenna patterns to determine a direction of origin of said signal.

22. The method of claim 21 wherein said first and second antenna elements are arranged along perpendicular axes and symmetrically with respect to a forty-five degree axis between said perpendicular axes.

23. The method of claim 21 wherein said producing a first antenna pattern comprises:

operating a switch to provide a signal feed to said first antenna element; and wherein producing a second antenna pattern comprises:

operating said switch to provide said signal feed to said second antenna element.

24. The method of claim 21 in which said comparing comprises using triangulation to determine the direction of origin.

25. A system for producing orthogonal signals, said system comprising:

means for producing a first antenna pattern;

means for producing a second antenna pattern orthogonal to said first antenna pattern, wherein said first and second producing means are coplanar and orthogonally oriented;

means for alternately switching signals to each of said first and second producing means; and means for canceling at least some impedance of said alternately switching means.

26. A system for providing multiple antenna patterns, said system comprising:

a first ungrounded antenna element;

a second ungrounded antenna element, wherein said first and second antenna elements are coplanar and arranged orthogonally with respect to each other in said plane;

a ground plane; and a feed circuit in communication with a signal feed line alternately connecting said signal feed line to each of said first and second antenna elements, wherein said first and second antenna elements are arranged along perpendicular axes and symmetrically with respect to a forty-five degree axis between said perpendicular axes, said ground plane arranged symmetrically with respect to forty-five degree axis.

27. The system of claim 26 in which the first ungrounded antenna element produces a first radiation pattern, and wherein the second ungrounded antenna element produces a second radiation pattern orthogonal to the first radiation pattern.

* * * * *

UNITED STATES PATENT AND TRADEMARK OFFICE

CERTIFICATE OF CORRECTION

PATENT NO. : 7,812,783 B2
APPLICATION NO. : 11/612315
DATED : October 12, 2010
INVENTOR(S) : Alan C. Mak et al.

It is certified that error appears in the above-identified patent and that said Letters Patent is hereby corrected as shown below:

Column 2, Lines 23-24, delete the portion of text reading "inventions" and replace with --invention--.

Column 4, Line 14, delete the portion of text reading "unit 21" and replace with --unit 210--.

Column 4, Line 17, delete the portion of bolded text reading "1.6" and replace with unbolded text --1.6--.

Column 4, Line 67, delete the portion of text reading "Strictures" and replace with --Structures--.

Column 6, Line 2, delete the portion of text reading "Semiconductor" and replace with --semiconductor--.

Column 6, Line 35, delete the portion of text reading "he" and replace with --be--.

Signed and Sealed this

Seventh Day of December, 2010

David J. Kappos

David J. Kappos
*Director of the United States Patent and Trademark Office*